US010754298B2

(12) United States Patent
Kaneko et al.

(10) Patent No.: US 10,754,298 B2
(45) Date of Patent: Aug. 25, 2020

(54) PORTABLE APPARATUS CASE, PORTABLE APPARATUS, AND TIMEPIECE

(71) Applicant: Seiko Instruments Inc., Chiba-shi, Chiba (JP)

(72) Inventors: Takahiro Kaneko, Chiba (JP); Teruo Kato, Chiba (JP); Hideaki Koshoji, Chiba (JP); Yasunori Hara, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 221 days.

(21) Appl. No.: 15/879,091

(22) Filed: Jan. 24, 2018

(65) Prior Publication Data

US 2018/0210401 A1 Jul. 26, 2018

(30) Foreign Application Priority Data

Jan. 26, 2017 (JP) ..... 2017-012248

(51) Int. Cl.
*G04B 37/14* (2006.01)
*G04B 37/00* (2006.01)

(52) U.S. Cl.
CPC ..... *G04B 37/1486* (2013.01); *G04B 37/0008* (2013.01)

(58) Field of Classification Search
CPC ..... A44C 5/14; A44C 5/16; A44C 5/2071; G04B 37/12; G04B 37/1486
See application file for complete search history.

(56) References Cited

U.S. PATENT DOCUMENTS 811,767 A * 2/1906 Drews ..... A44C 5/22 224/176
4,564,308 A * 1/1986 Ikegami ..... A44C 5/14 224/164
4,964,092 A * 10/1990 Brida ..... G04B 37/1486 224/170
5,222,765 A * 6/1993 Pileggi ..... A44B 18/00 281/15.1

(Continued)

FOREIGN PATENT DOCUMENTS

GB 101897 A 11/1916
JP 11-187911 A 7/1999

(Continued)

OTHER PUBLICATIONS

Masui, Noboru, English Translation of JPH11187911, originally published on Jul. 13, 1999, retrieved from Espacenet on Oct. 29, 2019, full document (Year: 1999).*

(Continued)

*Primary Examiner* — Daniel P Wicklund
(74) *Attorney, Agent, or Firm* — Brinks Gilson & Lione

(57) ABSTRACT

Disclosed are a portable apparatus case, a portable apparatus, and a timepiece allowing easy attachment. A timepiece case includes: a case main body, a first bow having a first passage hole and provided on the case main body, a strap one end portion of which is mounted to the first bow and the other end portion of which is passed through the first passage hole, and a fixation member provided on at least one of the first bow and a main portion of the strap extending from the first bow to the first passage hole and detachably connected to the strap.

7 Claims, 18 Drawing Sheets

(56) References Cited

U.S. PATENT DOCUMENTS

| | | | | | |
|---|---|---|---|---|---|
| 5,425,007 | A * | 6/1995 | Walter | A44C 5/22 | 224/176 |
| 6,073,821 | A * | 6/2000 | Mercer | A44C 5/22 | 224/176 |
| 6,130,861 | A * | 10/2000 | Della Felice | G04B 37/1486 | 368/276 |
| 8,122,519 | B2 * | 2/2012 | Schmelzer | A42B 1/24 | 2/170 |
| 9,052,695 | B1 * | 6/2015 | Fedan | A44C 5/147 | |
| 9,491,991 | B1 * | 11/2016 | Rong | A44C 5/2071 | |
| 2003/0182770 | A1 * | 10/2003 | Koshoji | A44C 5/0015 | 24/265 WS |
| 2016/0037841 | A1 * | 2/2016 | Dey | A41D 20/00 | 2/170 |
| 2018/0092438 | A1 * | 4/2018 | Vandenbussche | A44B 11/24 | |

FOREIGN PATENT DOCUMENTS

| | | | |
|---|---|---|---|
| JP | 2004-198355 | A | 7/2004 |
| JP | 2006-212107 | A | 8/2006 |
| JP | 2009-225834 | A | 10/2009 |
| JP | 2016-96955 | A | 5/2016 |

OTHER PUBLICATIONS

Office Action dated Feb. 20, 2018 for Japanese Application No. 2017-012248, 13 pages.

* cited by examiner

PORTABLE APPARATUS CASE, PORTABLE APPARATUS, AND TIMEPIECE

RELATED APPLICATIONS

This application claims priority under 35 U.S.C. § 119 to Japanese Patent Application Nos. 2017-012248 filed on Jan. 26, 2017, the entire content of which is hereby incorporated by reference.

BACKGROUND OF THE INVENTION

Field of the Invention

The present invention relates to a portable apparatus case, a portable apparatus, and a timepiece.

Description of the Related Art

Conventionally, as a portable apparatus case, there exists, for example, a portable apparatus case as disclosed in JP-A-2009-225834. The above-mentioned portable apparatus case is attached to the arm. The portable apparatus case is equipped with a case main body, and two straps fixed to both sides of the case main body. A buckle is provided at the distal end of one strap. The buckle has a buckle tongue. An annular loosely fitted member is passed onto the one strap. A lock hole is provided at the distal end side of the other strap.

When attaching the portable apparatus case to the arm, the following four operations are conducted:

(1) The case main body is placed on the arm, and the other strap is passed through the buckle of the one strap.

(2) The other strap is pulled to fasten both straps to the arm.

(3) The buckle tongue is passed through the lock hole of the other strap.

(4) The other strap is passed through the loosely fitted member and fixed to the one strap.

In the above portable apparatus case, it is necessary to perform the four operations at the time of attachment, which means the attachment takes time.

SUMMARY OF THE INVENTION

The present invention has been made in view of the above problem in the related art. It is an object of the present invention to provide a portable apparatus case, a portable apparatus, and a timepiece allowing easy attachment.

According to an aspect of the present invention, there is provided a portable apparatus case equipped with a case main body, a strap mounting portion having a passage hole and provided on the case main body, a strap one end portion of which is mounted to the strap mounting portion and the other end portion of which is passed through the passage hole, and a fixation member provided on at least one of the strap mounting portion and a main portion of the strap extending from the strap mounting portion to the passage hole and detachably connected to the strap.

In the above-described portable apparatus case, when attaching it to the arm or the like, it is only necessary to perform two operations (the strap fastening operation and the strap fixing operation), so that the requisite number of operations for the attachment is reduced as compared with the related art. Thus, it is possible to easily perform the attachment of the portable apparatus case.

In the portable apparatus case, the strap mounting portion may be provided at one end portion of the case main body, and a support portion supporting the main portion may be provided at the other end portion of the case main body.

In this construction, the strap is supported at both end portions of the case main body. Thus, in the portable apparatus case, it is possible to retain the case main body in a stable fashion.

The fixation member may be a lock portion provided on at least one of the strap mounting portion and the main portion, and detachably locked to a locked portion formed on an extension portion of the strap extending to the outer side of the passage hole.

In this construction, the extension portion can be fixed to at least one of the strap mounting portion and the main portion solely by locking the lock portion to the locked portion, so that the strap fixing operation is facilitated. Thus, in the portable apparatus case, the attachment can be conducted more easily.

In the portable apparatus case, the lock portion may be composed of a rotation portion rotatably provided on the strap mounting portion, an operation portion rotating the rotation portion, and a lock portion main body that can be switched between locking and non-locking to the locked portion in accordance with the rotational position of the rotation portion.

In this construction, by depressing the operation portion, the strap (extension portion) is fixed in position, so that the strap fixing operation is further facilitated.

The portable apparatus case may be equipped with a slip portion provided on at least one of the strap and a contact portion brought into contact with the strap, and configured to reduce the friction between the strap and the contact portion.

In this construction, the friction at the time of the strap fastening is reduced, and the strap is moved smoothly, so that the strap fastening operation is further facilitated. Thus, the attachment of the portable apparatus case can be conducted with ease.

The slip portion may be a protrusion at least the distal end portion of which is formed in a curved convex configuration.

In this construction, the friction at the time of strap fastening is further reduced, making it possible to easily perform the strap fastening operation.

The slip portion may be a rotation member provided on at least one of the strap and the contact portion, and rotatable around an axis crossing the length direction of the strap.

In this construction, it is possible to reduce the friction at the time of strap fastening, so that it is possible to easily fasten the strap.

According to another aspect of the present invention, there is provided a portable apparatus equipped with the portable apparatus case, and a portable apparatus component accommodated in the portable apparatus case.

In the above portable apparatus, in attaching it to the arm, it is only necessary to perform two operations (the strap fastening operation and the strap fixing operation), so that the number of the requisite operations for the attachment is reduced as compared with the related art. Thus, the attachment can be easily performed.

According to still another aspect of the present invention, there is provided a timepiece equipped with the portable apparatus case, and a movement accommodated in the portable apparatus case.

In the above timepiece, in attaching it to the arm, it is only necessary to perform two operations (the strap fastening operation and the strap fixing operation), so that the number of the requisite operations for the attachment is reduced as compared with the related art. Thus, the attachment can be easily performed.

The portable apparatus case, the portable apparatus, and the timepiece according to the present invention allow easy attachment.

DETAILED DESCRIPTION OF THE PREFERRED EMBODIMENTS

Next, embodiments of the present invention will be described with reference to the drawings.

First Embodiment

Figure 1:
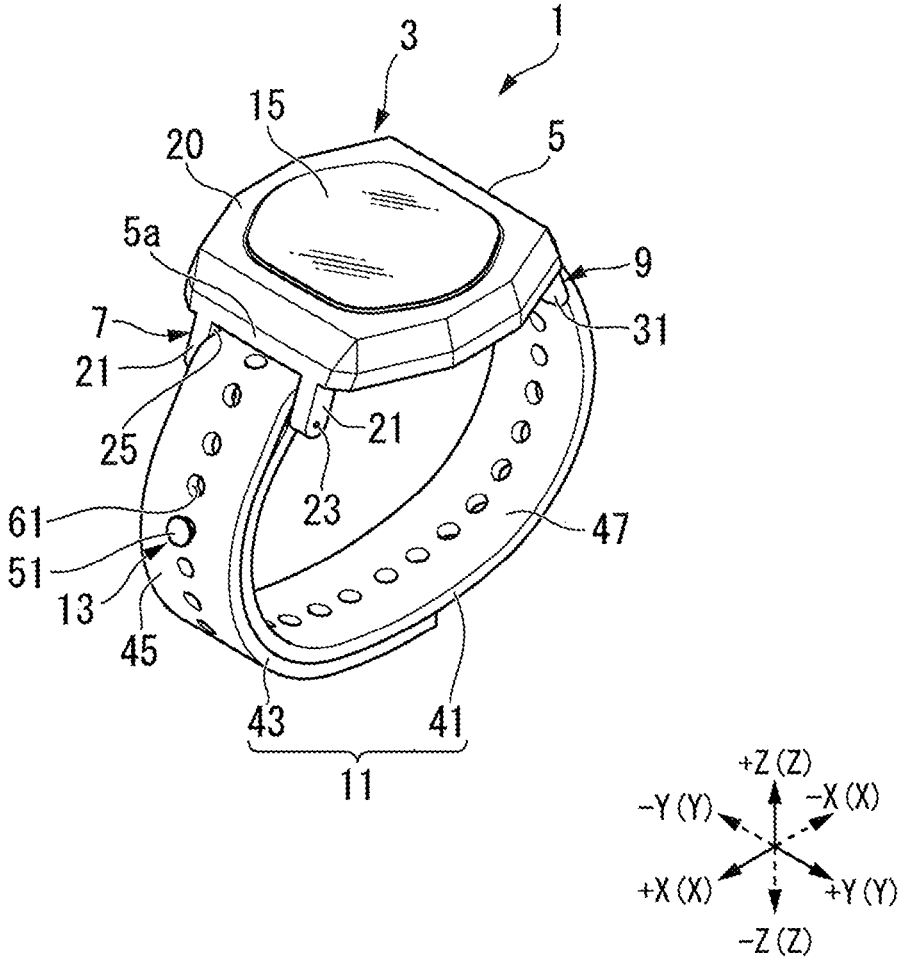
FIG. 1 is a perspective view of a timepiece according to a first embodiment of the present invention.

A timepiece (portable apparatus) 1 according to the first embodiment of the present invention will be described with reference to FIGS. 1 through 6. FIG. 1 is a perspective view of the timepiece 1 according to the first embodiment.

As shown in FIG. 1, the timepiece 1 is a watch type electronic timepiece. The timepiece 1 is attached to the arm (wrist). The timepiece 1 is equipped with a timepiece case 3 (portable apparatus case), and a timepiece movement (a portable apparatus component; hereinafter also referred to as a timepiece component).

The timepiece case 3 is equipped with a case main body 5, a first bow 7 (strap mounting portion), a second bow 9 (support portion), a strap 11, and a fixation member 13.

The case main body 5 is formed in a case-like configuration. A "case-like" structure is one capable, for example, of accommodating an object of accommodation.

The case main body 5 is provided with the above-mentioned timepiece component (movement). More specifically, a display portion 15 is provided on the surface (upper surface 20) of the case main body 5. The display portion 15 consists of a flat-plate-like liquid crystal display panel or the like, and displays information such as time. Accommodated in the case main body 5 are the movement, etc. The movement is equipped with a drive unit, a battery, etc., and controls the information display at the display portion 15.

In the following description, the XYZ-coordinate system will be used as needed.

One surface of the flat-plate-like case main body 5 is a lower surface 19 (See FIG. 2) on which the first bow 7 and the second bow 9 are provided. The other surface of the case main body 5 is the upper surface 20 on which the display portion 15 is provided.

The X-direction is along the one surface (lower surface 19) of the case main body 5, and is a direction passing one end portion 5*a* and the other end portion 5*b* of the case main body 5. Of the X-direction, the direction from the other end portion 5*b* toward the one end portion 5*a* will be referred to as the +X-direction, and the opposite direction will be referred to as the −X-direction. The Y-direction is a direction orthogonal to the X-direction in a plane along the one surface (lower surface 19) of the case main body 5. Of the Y-direction, one direction will be referred to as the +Y-direction, and the opposite direction will be referred to as the −Y-direction. The Z-direction is a direction orthogonal to the X-direction and the Y-direction. It is the thickness direction of the case main body 5. In some cases, of the Z-direction, the direction from the lower surface 19 toward the upper surface 20 will be referred to as upwards, and the opposite direction will be referred to as downwards.

The plane formed by the X-direction and the Y-direction is referred to as the XY-plane. The plane formed by the Y-direction and the Z-direction will be referred to as the YZ-plane. The plane formed by the X-direction and the Z-direction will be referred to as the XZ-plane.

The first bow 7 is provided at the one end portion 5*a* of the case main body 5. The first bow 7 is equipped with a pair of first bow legs 21 and a spring bar 23.

The first bow legs 21 are provided at the one end portion 5*a* of the case main body 5 so as to be spaced away from each other in the Y-direction. The first bow legs 21 are formed integrally, for example, with the case main body 5. The first bow legs 21 are formed so as to extend substantially downwards from the one end portion 5*a* of the case main body 5. More specifically, the first bow legs 21 extend downwards from the lower surface 19 of the one end portion 5*a* of the case main body 5 so as to be slightly tilted in the +X-direction.

The spring bar 23 is provided between the first bow legs 21. Both ends of the spring bar 23 are rotatably mounted to the lower portions (distal end portions in the extending direction) of the first bow legs 21.

Between the spring bar 23 and the one end portion 5*a* of the case main body 5, there is formed a first passage hole 25 (passage hole or passage portion). The first passage hole 25 allows insertion of the strap 11.

Figure 2:
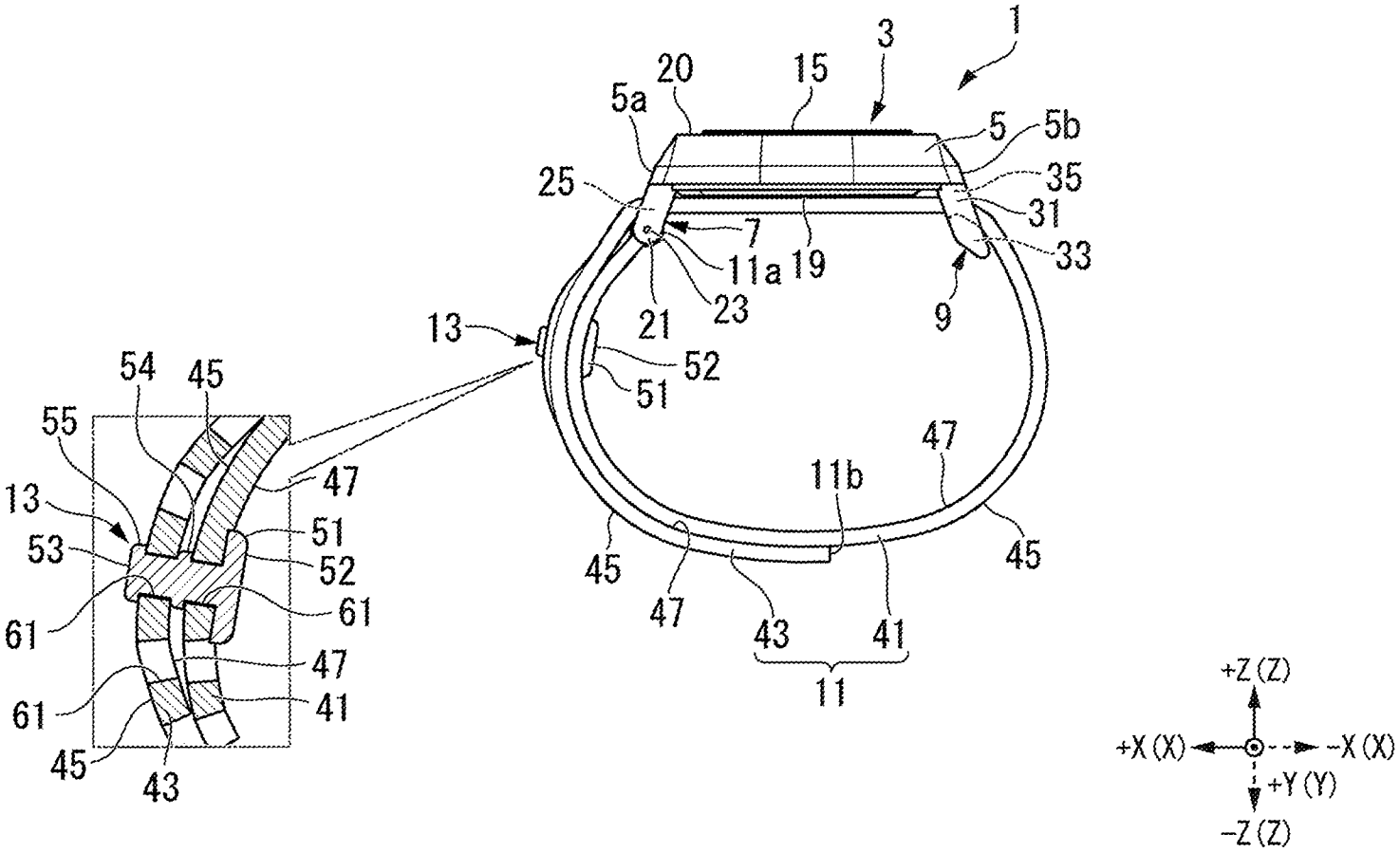
FIG. 2 is a side view of the timepiece according to the first embodiment.

FIG. 2 is a side view of the timepiece 1. The second bow 9 is provided at the other end portion 5*b* of the case main body 5. The second bow 9 is formed integrally, for example, with the case main body 5. The second bow 9 is equipped with second bow legs 31 and a connection portion 33.

The second bow legs 31 are provided at the other end portion 5*b* of the case main body 5 so as to be spaced away from each other in the Y-direction. The second bow legs 31 are formed so as to extend substantially downwards from the other end portion 5*b* of the case main body 5. More specifically, the second bow legs 31 extend downwards from the lower surface 19 of the other end portion 5*b* of the case main body 5 so as to be slightly tilted in the −X-direction.

The connection portion 33 is provided between the second bow legs 31. Both ends of the connection portion 33 reach the lower portions of the second bow legs 31 (the distal end portions in the extending direction). Between the connection portion 33 and the other end portion 5*b* of the case main body 5, there is formed a second passage hole 35. The second passage hole 35 allows insertion of the strap 11.

The strap 11 is a strap formed, for example, of leather or resin. The strap 11 can undergo elastic bending deformation in the thickness direction. The strap 11 can undergo elastic deformation so as to increase or decrease the inner diameter dimension, for example, of a lock hole 61.

One end portion 11 a of the strap 11 is mounted to the first bow 7. The other end portion 11*b* of the strap 11 is inserted into the first passage hole 25. That is, the length portion of the strap 11 including the other end portion 11*b* is inserted into the first passage hole 25.

From its one end portion 11*a* to the other end portion 11*b*, the strap 11 has a main portion 41 and an extension portion 43 (surplus length portion).

One end portion of the main portion 41 (one end portion 11*a* of the strap 11) is rotatably mounted to the spring bar 23. More specifically, the one end portion 11*a* is formed in a tubular configuration having an insertion hole, and the spring bar 23 is inserted into the insertion hole. The one end portion 11*a* is rotatable around an axis with respect to the spring bar 23.

The main portion 41 is the portion of the strap 11 extending from the first bow 7 to the first passage hole 25. The main portion 41 is formed in a ring-like configuration extending from the first bow 7 to the first passage hole 25 via the second bow 9. The main portion 41 is inserted into the second passage hole 35 from the outer side (−X-direction side) of the second bow 9 toward the inner side thereof (+X-direction side), and extends in the +X-direction along the lower surface 19 of the case main body 5 to reach the first passage hole 25. The main portion 41 is inserted into the second passage hole 35, so that it is supported by the connection portion 33 of the second bow 9. The main portion 41 may be of a "loop-like" or "annular" configuration.

The extension portion 43 is the portion of the strap 11 extending to the exterior of the main portion 41 from the first passage hole 25 to the other end portion 11*b* of the strap 11. The extension portion 43 is superimposed, for example, on a surface 45 of the main portion 41.

Formed in the main portion 41 and the extension portion 43 are a plurality of lock holes 61 extending through the strap 11 in the thickness direction. The lock holes 61 are of a circular configuration as seen in the thickness direction of the strap 11. The plurality of lock holes 61 are formed at different positions in, for example, the length direction of the strap 11. The plurality of lock holes 61 are formed at the intermediate portion in the width direction of the strap 11 side by side in the length direction of the strap 11. Of the lock holes 61 formed in the strap 11, a plurality of lock holes 61 formed in the extension portion 43 are an example of the "locked portion."

Figure 3:
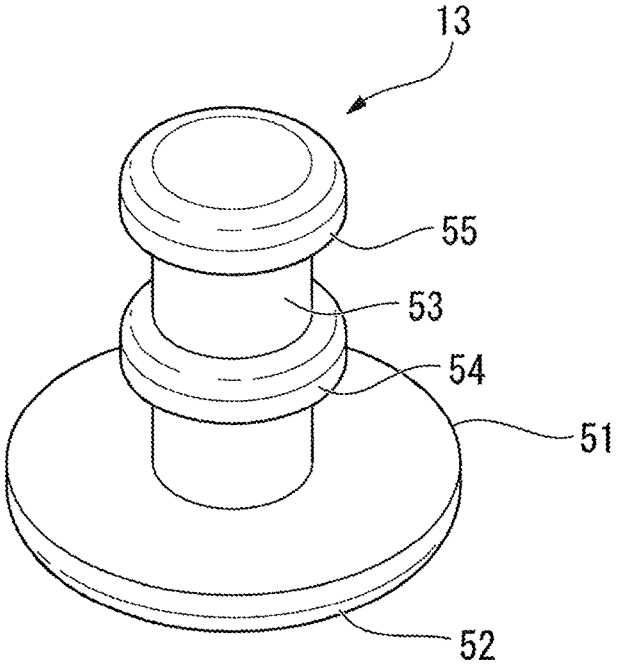
FIG. 3 is a perspective view of a fixation member of the timepiece according to the first embodiment.

FIG. 3 is a perspective view of the fixation member 13.

As shown in FIG. 3, the fixation member 13 is equipped with a lock portion 51. The lock portion 51 has a head portion 52 and a shaft portion 53. The head portion 52 is formed, for example, in a disc-like configuration.

For example, the shaft portion 53 is formed so as to protrude perpendicularly with respect to the head portion 52 from the center of one surface of the head portion 52. The shaft portion 53 is, for example, formed in a columnar configuration in which the axial direction coincides with the protruding direction, and the outer dimension (outer diameter) of the shaft portion 53 is smaller than the outer dimension (outer diameter) of the head portion 52. The outer dimension (outer diameter) of the shaft portion 53 is smaller, for example, than the inner diameter of the lock holes 61. Thus, the shaft portion 53 can be inserted into the lock hole 61.

Formed on the outer peripheral surface of the shaft portion 53 are a first annular protrusion 54 and a second annular protrusion 55. The first annular protrusion 54 is, for example, an annular protrusion. The first annular protrusion 54 is formed at the intermediate portion in the length direction of the shaft portion 53. The second annular protrusion 55 is formed at the distal end portion in the length direction of the shaft portion 53. The second annular protrusion 55 is, for example, an annular protrusion.

The first annular protrusion 54 and the second annular protrusion 55 protrude outwards in the radial direction of the shaft portion 53 from the outer peripheral surface of the shaft portion 53, and are formed over the entire periphery of the shaft portion 53. The central axes of the first annular protrusion 54 and the second annular protrusion 55 coincide, for example, with the central axis of the shaft portion 53. There are no particular restrictions regarding the sectional configuration (the sectional configuration along the central axis of the shaft portion 53) of the first annular protrusion 54 and the second annular protrusion 55. It may be, for example, of a semi-circular, rectangular, or reverse-V-shaped configuration.

At least a part of the first annular protrusion 54 has, for example, an outer dimension (outer diameter) larger than the inner diameter of the lock holes 61 of the strap 11 (the main portion 41 and the extension portion 43). The outer dimension (outer diameter) of the first annular protrusion 54 is such as will allow passage through the lock hole 61 by pushing open the lock hole 61. Thus, by pushing open the lock hole 61, it can pass through the lock hole 61, and can be detachably locked to the peripheral edge portion of the lock hole 61.

At least a part of the second annular protrusion 55 has, for example, an outer dimension (outer diameter) larger than the inner diameter of the lock holes 61 of the strap 11 (the extension portion 43). The outer dimension (outer diameter) of the second annular protrusion 55 is such as will allow passage through the lock hole 61 by pushing open the lock hole 61. Thus, by pushing open the lock hole 61, it can pass through the lock hole 61, and can be detachably locked to the peripheral edge portion of the lock hole 61.

The distance between the head portion 52 and the first annular protrusion 54 is, for example, the same as or somewhat larger than the thickness of the strap 11 (the main portion 41). The distance between the first annular protrusion 54 and the second annular protrusion 55 is, for example, the same as or somewhat larger than the thickness of the strap 11 (the extension portion 43).

The lock portion 51 can be attached to any of the plurality of lock holes 61.

As shown in FIG. 2, the shaft portion 53 of the lock portion 51 is inserted into the lock holes 61 of the main portion 41 and the extension portion 43 from a back surface 47 side of the main portion 41. The head portion 52 is arranged on the back surface 47 of the main portion 41.

The shaft portion 53 is inserted into the lock holes 61 of the main portion 41 and the extension portion 43, whereby the extension portion 43 is regulated in the movement in the length direction with respect to the main portion 41.

The first annular protrusion 54 is between the main portion 41 and the extension portion 43, and is detachably locked to the front surface 45 side peripheral edge portion of the lock hole 61 of the main portion 41 and the back surface 47 side peripheral edge portion of the lock hole 61 of the extension portion 43. The second annular protrusion 55 is on the front surface 45 side of the extension portion 43, and is detachably locked to the front surface 45 side peripheral edge portion of the lock hole 61 of the extension portion 43. As a result, the main portion 41 and the extension portion 43 are set in position with respect to the lock portion 51. Thus, the extension portion 43 is detachably connected and fixed to the main portion 41.

Figure 4:
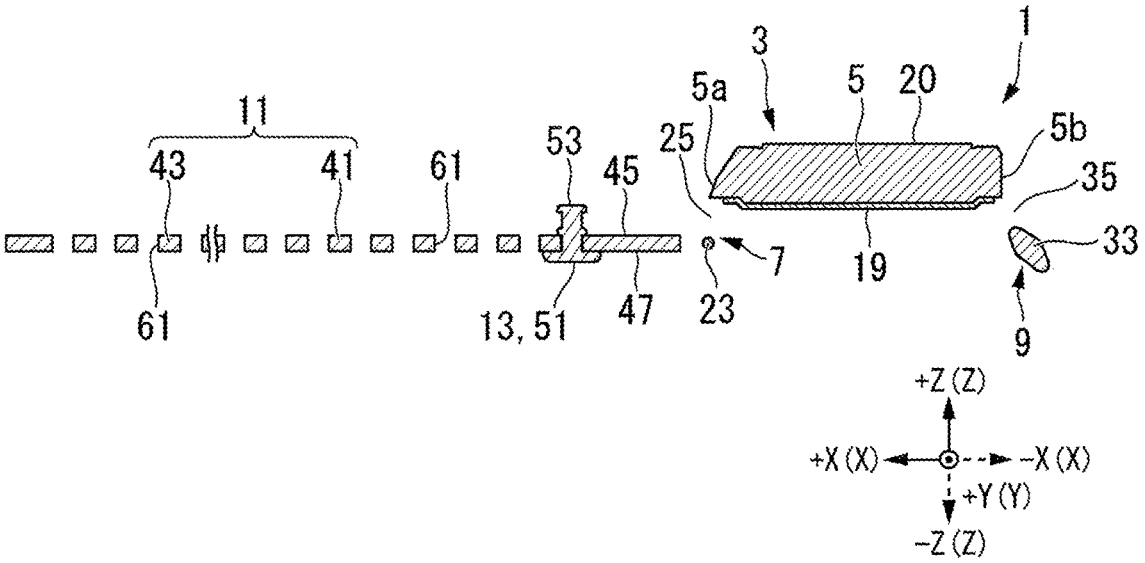
FIG. 4 is a diagram illustrating an attachment method for the timepiece according to the first embodiment.
Figure 5:
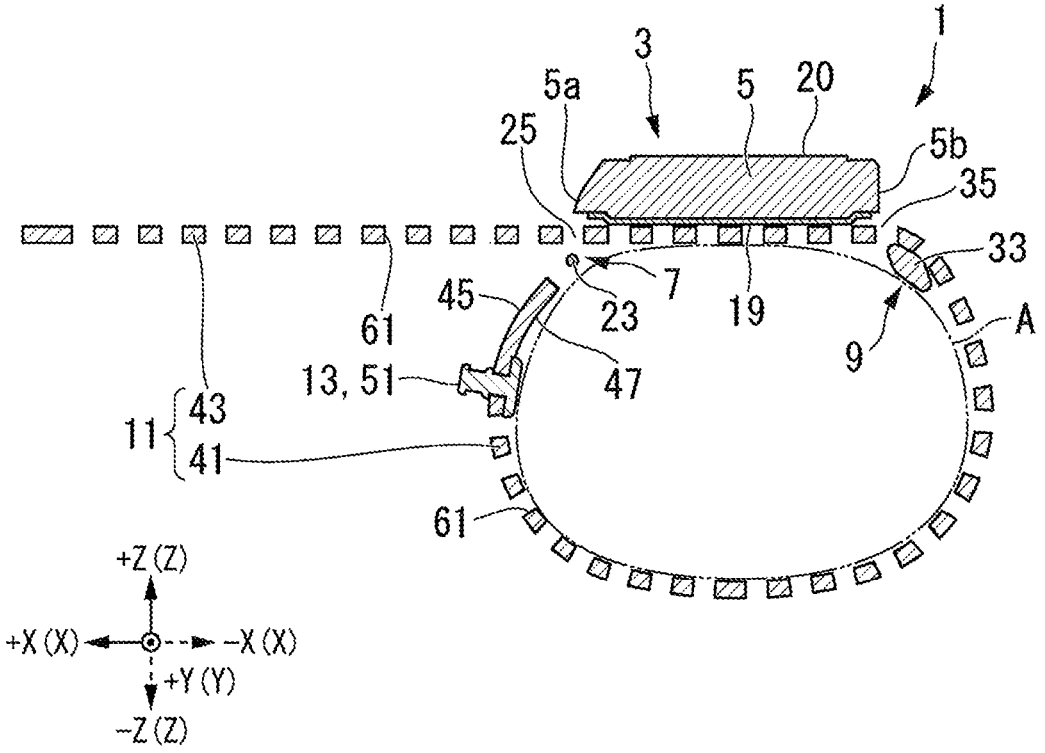
FIG. 5 is a diagram, succeeding to FIG. 4, illustrating the timepiece attachment method.
Figure 6:
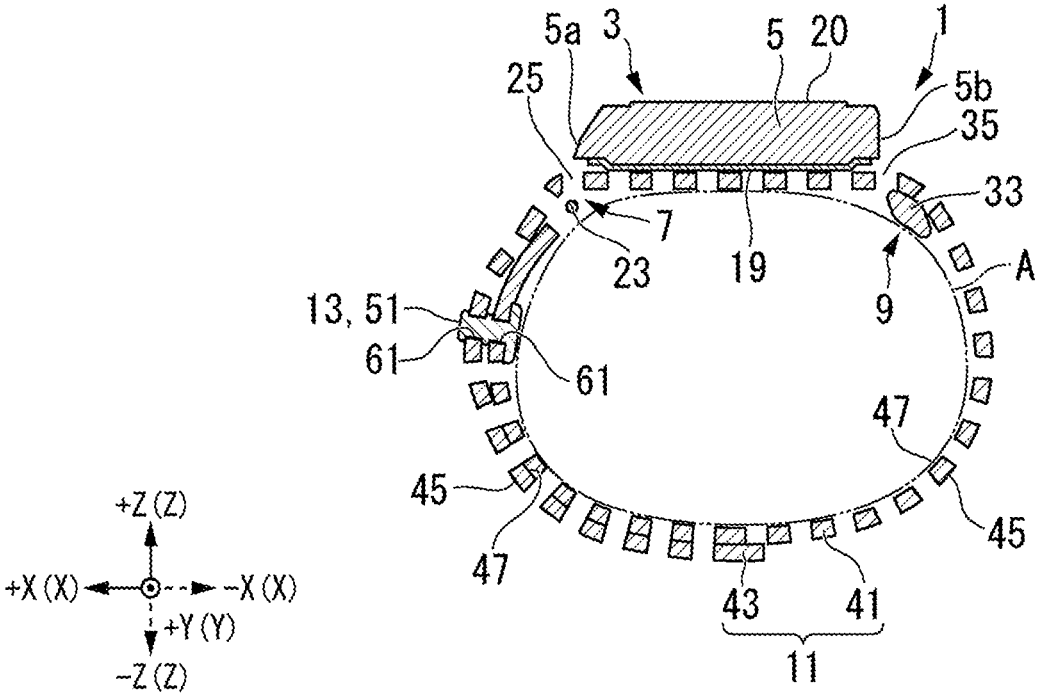
FIG. 6 is a diagram, succeeding to FIG. 5, illustrating the timepiece attachment method.

FIGS. 4 through 6 are diagram illustrating a method of attaching the timepiece 1. The method of attaching the timepiece 1 will be described with reference to FIGS. 4 through 6.

[1] Formation of the Main Portion 41

In the state shown in FIG. 4, in which the strap 11 is extended, the distal end portion of the strap 11 is successively passed through the second passage hole 35 and the first passage hole 25 to form the ring-like main portion 41. The main portion 41 is in the condition in which an arm A is passed therethrough. The lock portion 51 may be previously attached to the lock hole 61 of the strap 11 constituting the main portion 41, or it may be attached to the lock hole 61 at the time of a fixing operation (described below).

[2] Strap 11 Fastening Operation

As shown in FIG. 5, in the state in which the arm A is passed through the main portion 41, the extension portion 43 is pulled to fasten the strap 11 (main portion 41) to the arm A.

[3] Strap 11 Fixing Operation

As shown in FIG. 6, the extension portion 43 is superimposed on the main portion 41, and the lock portion 51 is inserted into the lock hole 61 of the extension portion 43 for locking, thereby fixing the extension portion 43 to the main portion 41. As a result, the strap 11 is fixed to the arm A, and the timepiece 1 is attached to the arm A.

The effects of the timepiece case 3 will be described.

(1) When attaching the timepiece case 3 to the arm A, it is only necessary to perform two operations with one hand (the strap 11 fastening operation and the strap 11 fixing operation) in the state in which the arm A has been passed through the main portion 41, so that the number of the requisite operations for attachment is reduced as compared with the related-art timepiece case. Thus, the timepiece case 3 allows easy attachment.

(2) In the timepiece case 3, the second bow 9 supporting the main portion 41 is provided at the other end portion 5*b* of the case main body 5. As a result, the strap 11 is supported by both end portions (the one end portion 5*a* and the other end portion 5*b*) of the case main body 5. Thus, at the time of attachment, the timepiece case 3 can retain the case main body 5 in a stable manner.

(3) In the timepiece case 3, the extension portion 43 can be fixed to the main portion 41 solely by locking the lock portion 51 to the lock hole 61, so that the strap 11 fixing operation is facilitated. Thus, the timepiece case 3 can further facilitate the attachment.

(4) In the timepiece case 3, the lock portion 51 can be detachably locked to any of the plurality of lock holes 61 of the main portion 41, so that it is possible to arbitrarily determine the fixing position of the strap 11. Thus, it is possible, for example, to provide the lock portion 51 at a position where an external force is not easily exerted. Thus, the timepiece case 3 is superior in usability.

(5) In the timepiece 3, the second bow 9 is formed integrally with the case main body 5, so that, as compared with the case where the second bow 9 is formed as a member separate from the case main body 5, the number of components is reduced, thereby suppressing an increase in component cost. Thus, in the timepiece case 3, it is possible to suppress the production cost.

(6) In the timepiece case 3, the strap 11 is used without being folded back, so that it is possible to suppress the load applied to the strap 11 at the time of attachment/detachment. Thus, the timepiece case 3 can prevent damage such as fracture of the surface of the strap 11, which proves the timepiece case to be superior in durability.

(7) In the timepiece case 3, the strap 11 is used without being folded back, so that there is generated no gap due to the folding back of the strap 11. As a result, it is possible to suppress an increase in the dimension in the thickness direction of the strap 11 at the end of the case main body 5. Thus, the timepiece case 3 provides a satisfactory attachment comfort, and is superior in external view (outward appearance).

(8) In the timepiece case 3, the first bow 7 and the second bow 9 are formed integrally with the case main body 5, so that the production of the case main body 5 is easy, and it is possible to suppress the production cost.

(9) The timepiece 1 is equipped with the timepiece case 3, so that, when attaching it to the arm A, it is only necessary to perform two operations with one hand (the strap 11 fastening operation and the strap 11 fixing operation), so that the requisite number of operations for the attachment is reduced as compared with the related art. Thus, the timepiece 1 allows easy attachment.

While in the above embodiment the timepiece case 3 is equipped with the first bow 7 and the second bow 9, the construction of the timepiece case is not restricted thereto. In the timepiece case of the embodiment, it is only necessary that the portion including the other end portion of the strap be inserted into the first passage hole of the first bow and be fixed to the strap. For example, as described below, a construction equipped with no second bow is also possible.

Second Embodiment

A timepiece 101 according to the second embodiment of the present invention will be described with reference to FIGS. 7 through 9. The components that are the same as those of the above-described embodiment are indicated by the same reference numerals, and a description thereof will be left out.

Figure 7:
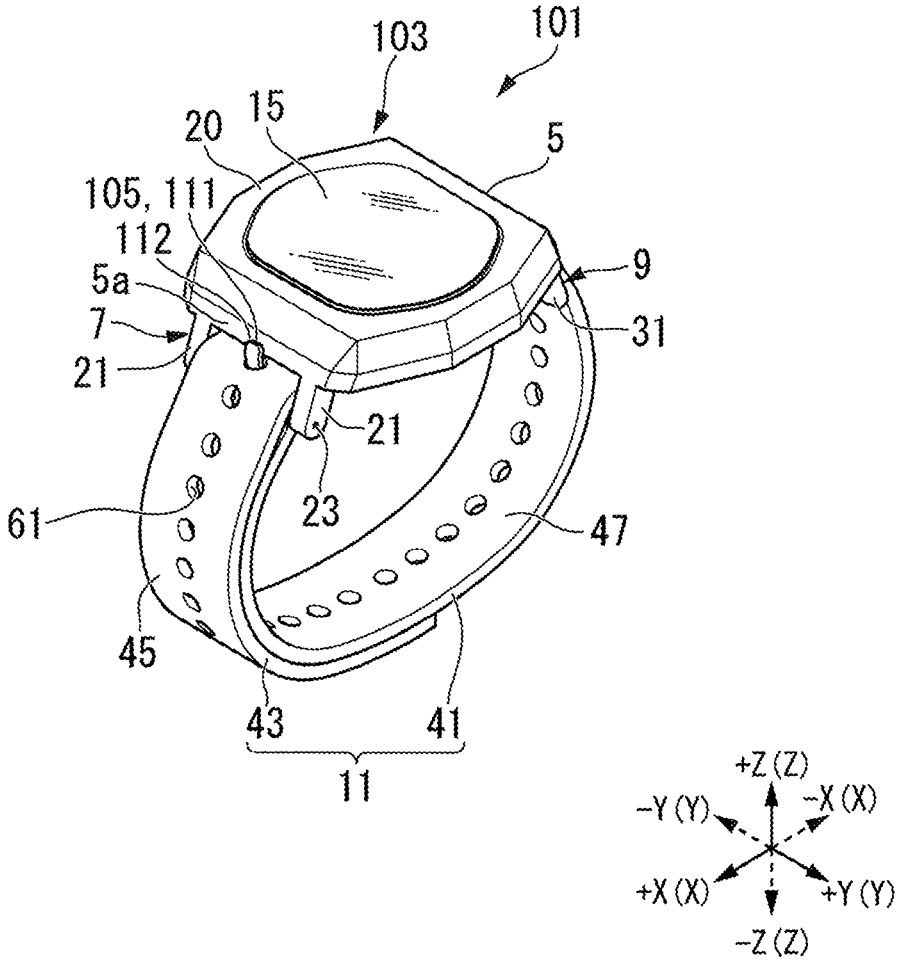
FIG. 7 is a perspective view of a timepiece according to a second embodiment of the present invention.

FIG. 7 is a perspective view of the timepiece 101 according to the second embodiment. FIGS. 8 and 9 are diagrams illustrating the timepiece 101 and a method of attaching the same.

The timepiece 101 is equipped with a timepiece case 103, and a timepiece component (movement). The timepiece case 103 is equipped with the case main body 5, the first bow 7, the second bow 9, the strap 11, and a fixation member 105.

The fixation member 105 is equipped with a buckle tongue 111 (lock portion). The buckle tongue 111 is equipped with a proximal end portion 131 and a lock bar portion 112. The proximal end portion 131 is formed in a tubular configuration having an insertion hole. The spring bar 23 is inserted into the insertion hole of the proximal end portion 131, whereby the buckle tongue 111 is rotatable around the spring bar 23.

The lock bar portion 112 extends from the outer peripheral surface of the proximal end portion 131 perpendicularly with respect to the extending direction of the proximal end portion 131 (the Y-direction). The lock bar portion 112 extends to the outer side of the main portion 41.

Figure 8:
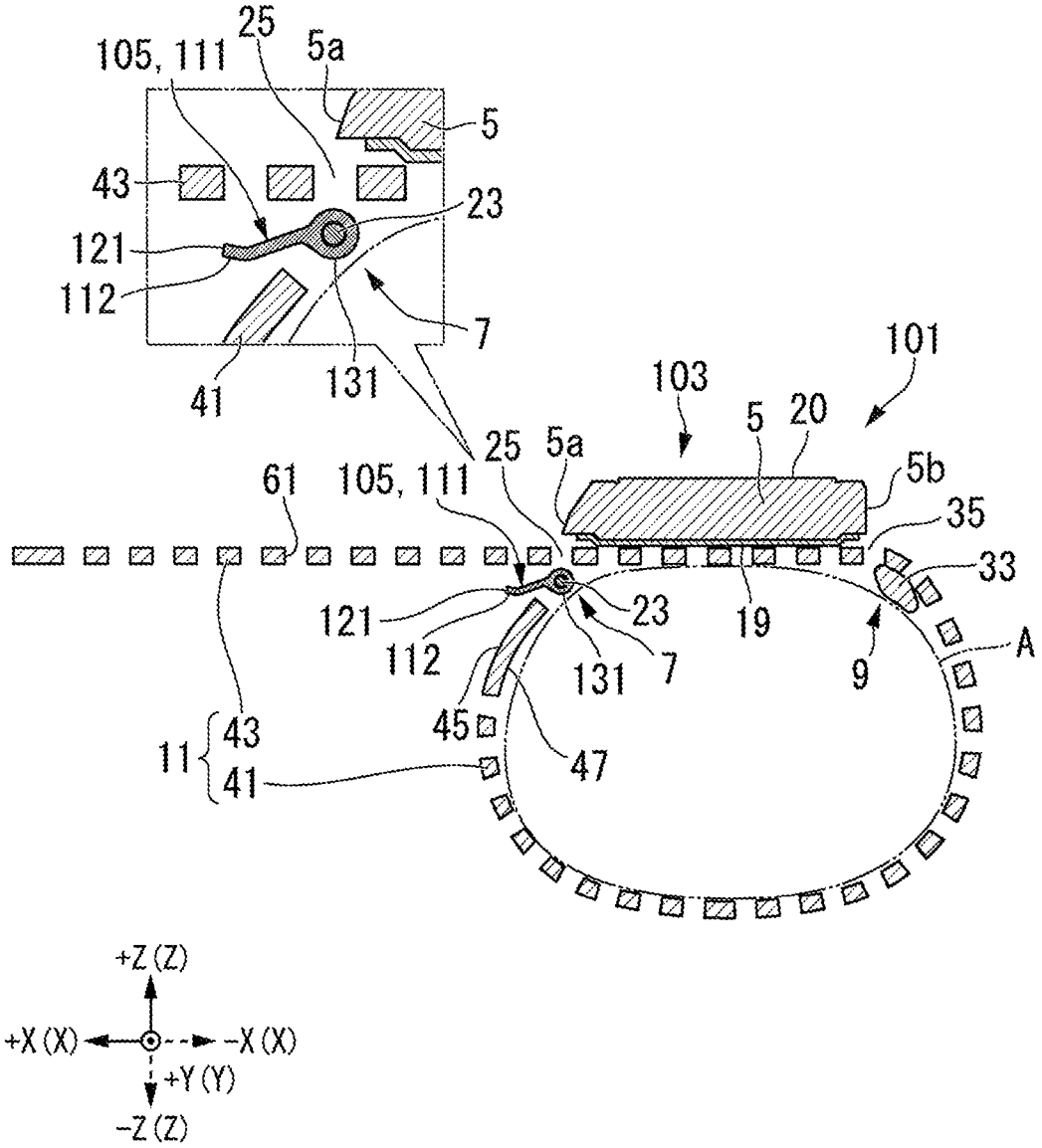
FIG. 8 is a diagram illustrating the timepiece according to the second embodiment and a method of attaching the same.
Figure 9:
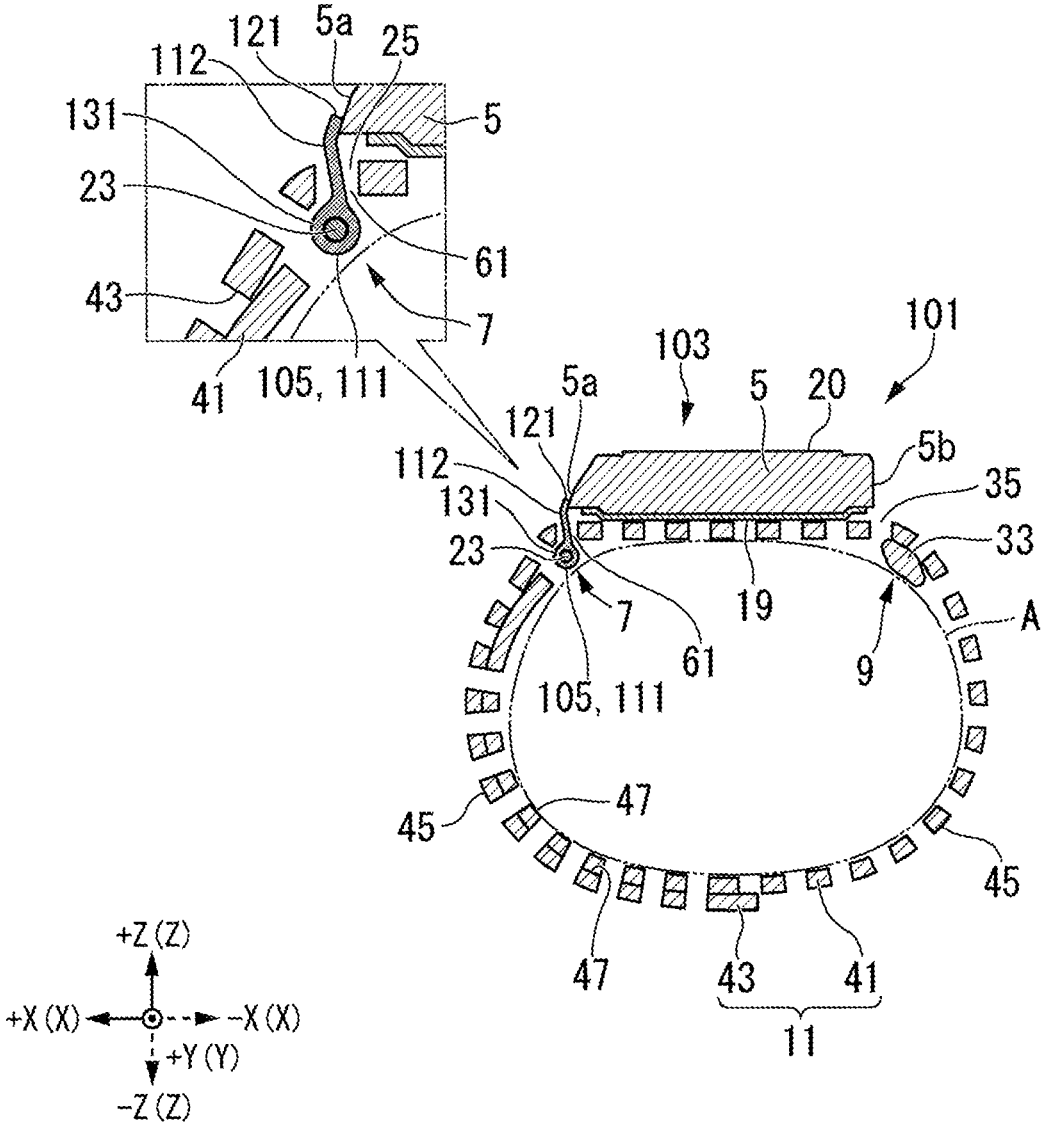
FIG. 9 is a diagram, succeeding to FIG. 8, illustrating the timepiece attachment method.

In accordance with its rotational position around the spring bar 23, the buckle tongue 111 can be switched between a non-locking state in which the lock bar portion 112 is not passed through the lock hole 61 (See FIG. 8) and a locking state in which the lock bar portion 112 is passed through the lock hole 61 of the extension portion 43 to effect locking (See FIG. 9). In the locking state, the lock bar portion 112 is locked, of the plurality of lock holes 61 of the extension portion 43, to the lock hole 61 situated in the vicinity of the first passage hole 25.

In the state in which the lock bar portion 112 is passed through the lock hole 61, a distal end portion 121 of the lock bar portion 112 can come into contact with the one end portion 5*a* of the case main body 5. In the locking state, the lock bar portion 112 comes into contact with the one end portion 5*a* of the case main body 5 in the state in which it is passed through the lock hole 61, whereby the extension portion 43 is regulated in the movement in the length direction with respect to the first bow 7. Thus, the buckle tongue 111 is locked to the lock hole 61, whereby the extension portion 43 is detachably connected to the first bow 7.

The buckle tongue 111 can be attached to any of the plurality of lock holes 61. At any position in the length direction of the main portion 41, there may be provided a free ring fixing the extension portion 43 to the main portion 41.

A method of attaching the timepiece 101 will be described with reference to FIGS. 8 and 9.

[1] Strap 11 Fastening Operation

As shown in FIG. 8, in the state in which the arm A is passed through the main portion 41, the extension portion 43 is pulled, whereby the strap 11 is fastened to the arm A.

[2] Strap 11 Fixing Operation

As shown in FIGS. 8 and 9, the buckle tongue 111 is inserted into the lock hole 61 of the extension portion 43 to lock it, and the distal end portion 121 is brought into contact with the one end portion 5*a* of the case main body 5. As a result, the extension portion 43 is fixed to the first bow 7. The extension portion 43 is superimposed on the main portion 41. As a result, the timepiece 101 is attached to the arm A.

The effects of the timepiece case 103 will be described.

(1) In the timepiece case 103, the strap 11 can be fixed to the first bow 7 solely by locking the buckle tongue 111 to the lock hole 61, so that the strap 11 fixing operation is facilitated. Thus, in the timepiece case 103, the attachment can be easily performed.

(2) In the timepiece case 103, the strap 11 can be fixed to the first bow 7 by passing the buckle tongue 111 through the lock hole 61, so that the strap 11 can be reliably fixed to the first bow 7.

(3) In the timepiece case 103, it is possible to use a general-purpose buckle tongue as the buckle tongue 111, so that it is possible to suppress the component cost. Thus, in the timepiece case 103, it is possible to suppress the production cost.

Apart from this, the timepiece case 103 provides the effects as described in connection with the first embodiment.

Third Embodiment

A timepiece 201 according to the third embodiment of the present invention will be described with reference to FIGS. 10 and 11. The components that are the same as those of the above-described embodiments are indicated by the same reference numerals, and a description thereof will be left out.

Figure 10:
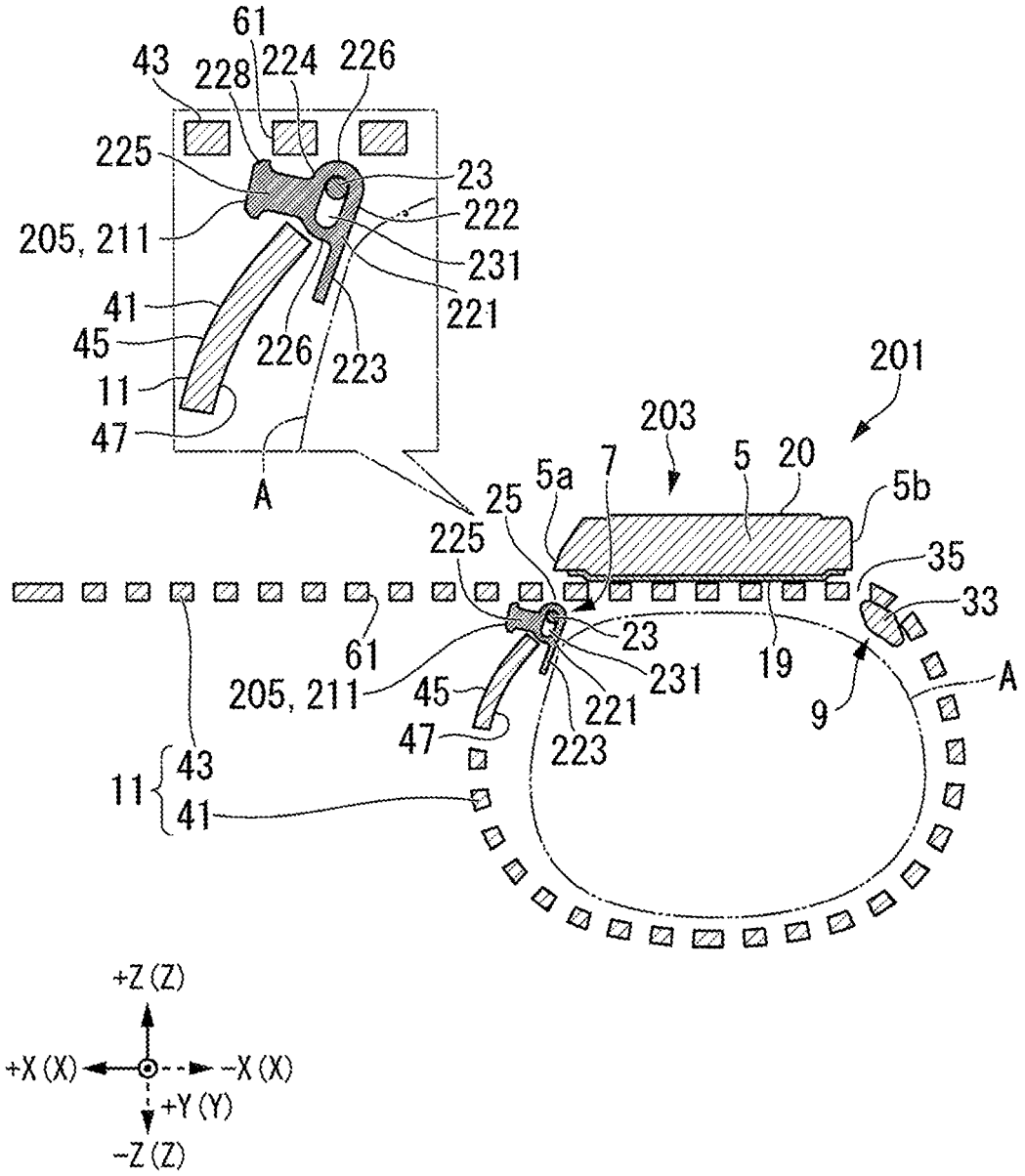
FIG. 10 is a diagram illustrating a timepiece according to a third embodiment of the present invention and a method of attaching the same.
Figure 11:
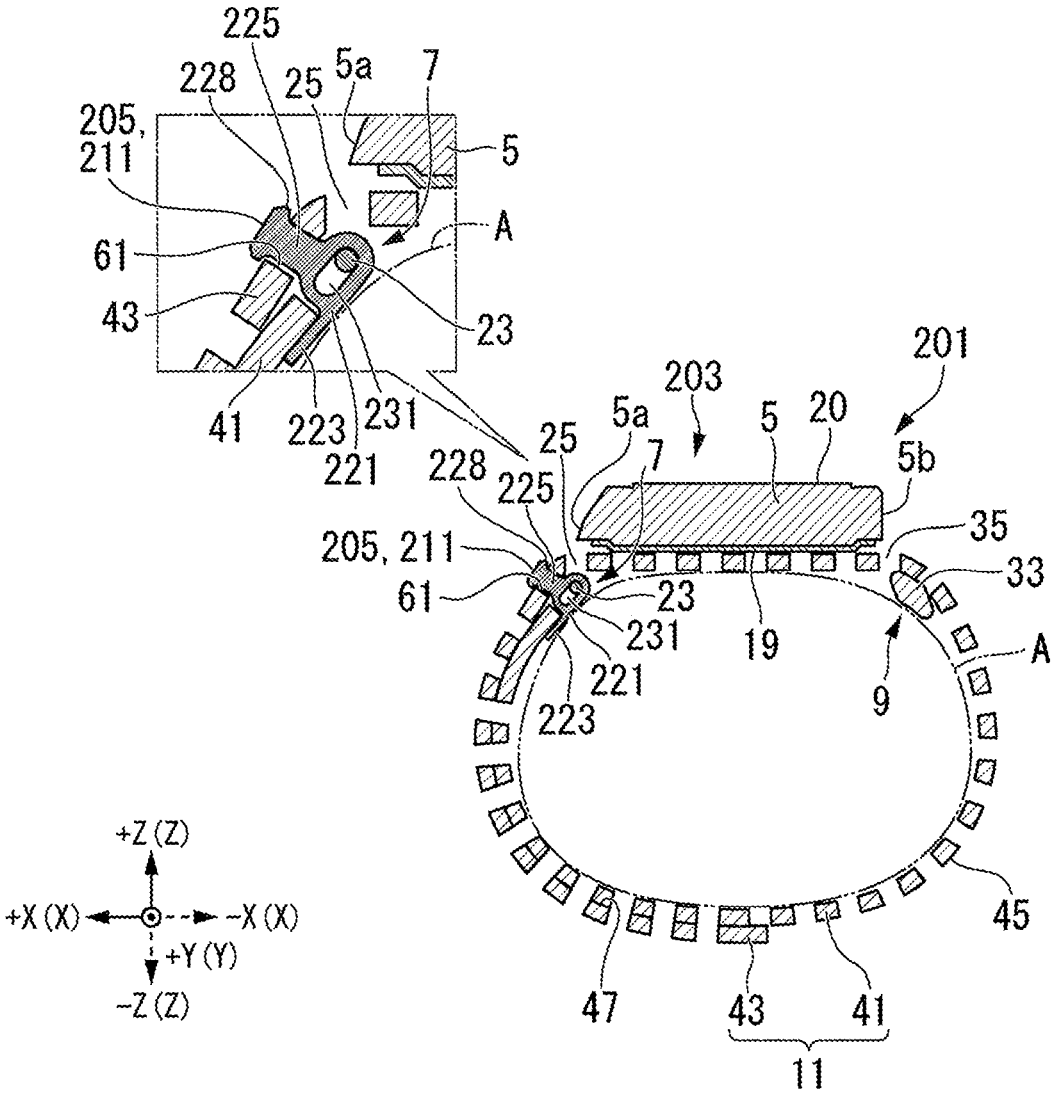
FIG. 11 is a diagram, succeeding to FIG. 10, illustrating the timepiece attachment method.

FIGS. 10 and 11 are diagrams illustrating the timepiece 201 according to the third embodiment and a method of attaching the same. The timepiece 201 is equipped with a timepiece case 203 and a timepiece component (movement). The timepiece case 203 is equipped with the case main body 5, the first bow 7, the second bow 9, the strap 11, and a fixation member 205.

The fixation member 205 is equipped with a lock portion 211. The lock portion 211 is rotatably provided on the first bow 7. The lock portion 211 is equipped with a rotation portion 221, an operation portion 223, and a lock protrusion (lock portion main body) 225.

The rotation portion 221 is formed, for example, in a tubular configuration the XZ-sectional configuration of the inner space of which is elliptical. The rotation portion 221 is equipped, for example, with an inner plate 222, an outer plate 224, and side plates 226. The inner plate 222 and the outer plate 224 are of a flat-plate-like configuration, and are parallel to each other. The side plates 226 are of a curved concave configuration, and are formed at one end portion and the other end portion in the major axis direction of the inner plate 222 and the outer plate 224. The inner space of the rotation portion 221 is, for example, an elongated hole 231 the XZ-sectional configuration of which is elliptical.

The spring bar 23 is inserted into the elongated hole 231, whereby the rotation portion 221 is rotatable around the spring bar 23 with respect to the first bow 7.

For example, in the state in which the spring bar 23 is inserted into the elongated hole 231, the rotation portion 221 can move in the major axis direction of the elongated hole 231.

The operation portion 223 is formed, for example, in a flat-plate-like configuration extending along the inner plate 222. The operation portion 223 is formed, for example, so as to protrude from one end portion of the inner plate 222 of the rotation portion 221 along the inner plate 222 away from the rotation portion 221.

The operation portion 223 is arranged on the inner side of the main portion 41. As shown in FIGS. 10 and 11, the operation portion 223 is pushed outwardly while in contact with the arm A, whereby it is rotated clockwise as seen in FIGS. 10 and 11.

The lock protrusion 225 is formed, for example, so as to protrude from the outer surface of the outer plate 224 perpendicularly with respect to the outer plate 224 away from the outer plate 224. The lock protrusion 225 protrudes to the outer side of the main portion 41.

Formed at the distal end portion in the protruding direction of the lock protrusion 225 is an annular protrusion 228 protruding outwards in the radial direction of the lock protrusion 225. At least a part of the annular protrusion 228 has, for example, an outer dimension (outer diameter) larger than the inner diameter of the lock hole 61 of the strap 11 (the extension portion 43). The outer dimension (outer diameter) of the annular protrusion 228 is such as will allow passage through the lock hole 61 by pushing open the lock hole 61 of the strap 11 (the extension portion 43). Thus, the annular protrusion 228 can pass through the lock hole 61 by pushing open the lock hole 61, and can be detachably engaged with the peripheral edge portion of the lock hole 61.

The distance between the rotation portion 221 and the annular protrusion 228 is, for example, the same as or somewhat larger than the thickness of the strap 11 (the extension portion 43).

The lock portion 211 can be attached to any of the plurality of lock holes 61.

In accordance with the rotational position around the spring bar 23, the lock portion 211 can be switched between a non-locking state in which the lock protrusion 225 is not inserted into the lock hole 61 (See FIG. 10) and a locking state in which the lock protrusion 225 is inserted into the lock hole 61 of the extension portion 43 for locking (See FIG. 11). In the locking state, of the plurality of lock holes 61 of the extension portion 43, the lock protrusion 225 is locked to the lock hole 61 situated in the vicinity of the first passage hole 25.

In the locking state, the extension portion 43 is regulated in the movement in the length direction with respect to the main portion 41. The annular protrusion 228 is detachably locked to the peripheral edge portion of the front surface 45 side of the lock hole 61 of the extension portion 43.

The lock protrusion 225 is locked to the lock hole 61, whereby the extension portion 43 is detachably connected to the first bow 7.

The method of attaching the timepiece 201 will be described with reference to FIGS. 10 and 11.

[1] Strap 11 Fastening Operation

As shown in FIG. 10, in the state in which the arm A is passed into the main portion 41, the extension portion 43 is pulled, and the strap 11 (the main portion 41) is fastened to the arm A.

[2] Strap 11 Fixing Operation

As shown in FIG. 11, when the strap 11 is fastened to the arm A, the operation portion 223 is pushed by the arm A to rotate clockwise as seen in FIG. 11. As a result, the lock protrusion 225 assumes an attitude in which the protruding dimension from the surface 45 of the main portion 41 is large, that is, an attitude in which locking to the lock hole 61 is easy. The lock protrusion 225 is locked to the lock hole 61 situated in the vicinity of the first passage hole 25, and the extension portion 43 is connected to the first bow 7. As a result, the strap 11 is fixed to the arm A, and the timepiece 201 is attached to the arm A.

The effects of the timepiece case 203 will be described.

(1) In the timepiece case 203, the extension portion 43 can be connected to the first bow 7 by locking the lock portion 211 to the lock hole 61, so that the strap 11 fixing operation is facilitated. Thus, the timepiece case 203 allows easy attachment.

(2) In the timepiece case 203, the arm A pushes the operation portion 223, whereby the lock protrusion 225 assumes an attitude allowing easy locking to the lock hole 61, and the strap 11 (the extension portion 43) is fixed, so that the strap 11 fixing operation is further facilitated.

(3) In the timepiece case 203, the rotation portion 221 can move in the major axis direction of the elongated hole 231, so that it is possible to adjust the position of the rotation portion 221 to adjust the position of the lock protrusion 225. Thus, the operation of detaching the lock protrusion 225 from the lock hole 61 is facilitated. Further, it is possible to lock the lock protrusion 225 easily to the target lock hole 61. Thus, the timepiece case 203 is superior in usability.

Apart from this, the timepiece case 203 provides the effects as described in connection with the first embodiment.

Fourth Embodiment

A timepiece 301 according to the fourth embodiment of the present invention will be described with reference to FIGS. 12 and 13. The components that are the same as those of the above-described embodiments are indicated by the same reference numerals, and a description thereof will be left out.

Figure 12:
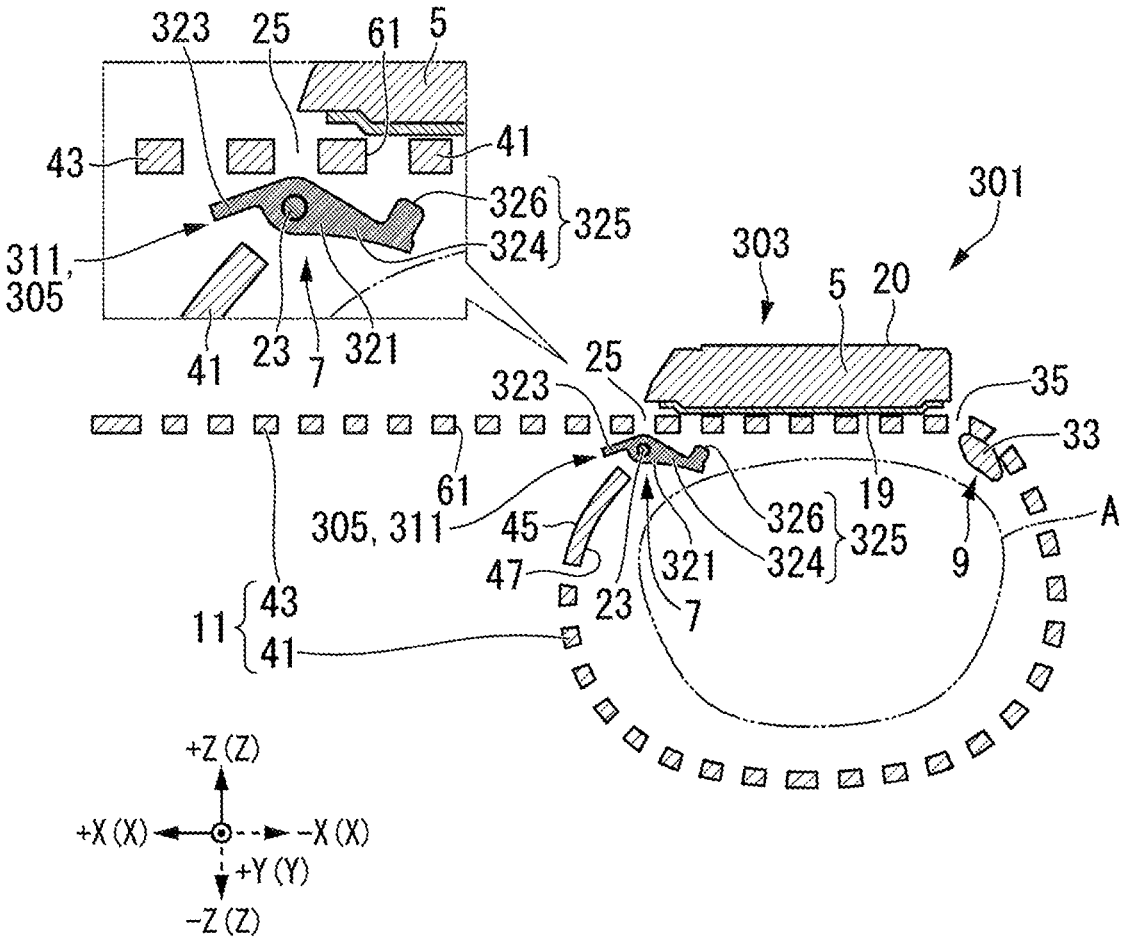
FIG. 12 is a diagram illustrating a timepiece according to a fourth embodiment of the present invention and a method of attaching the same.
Figure 13:
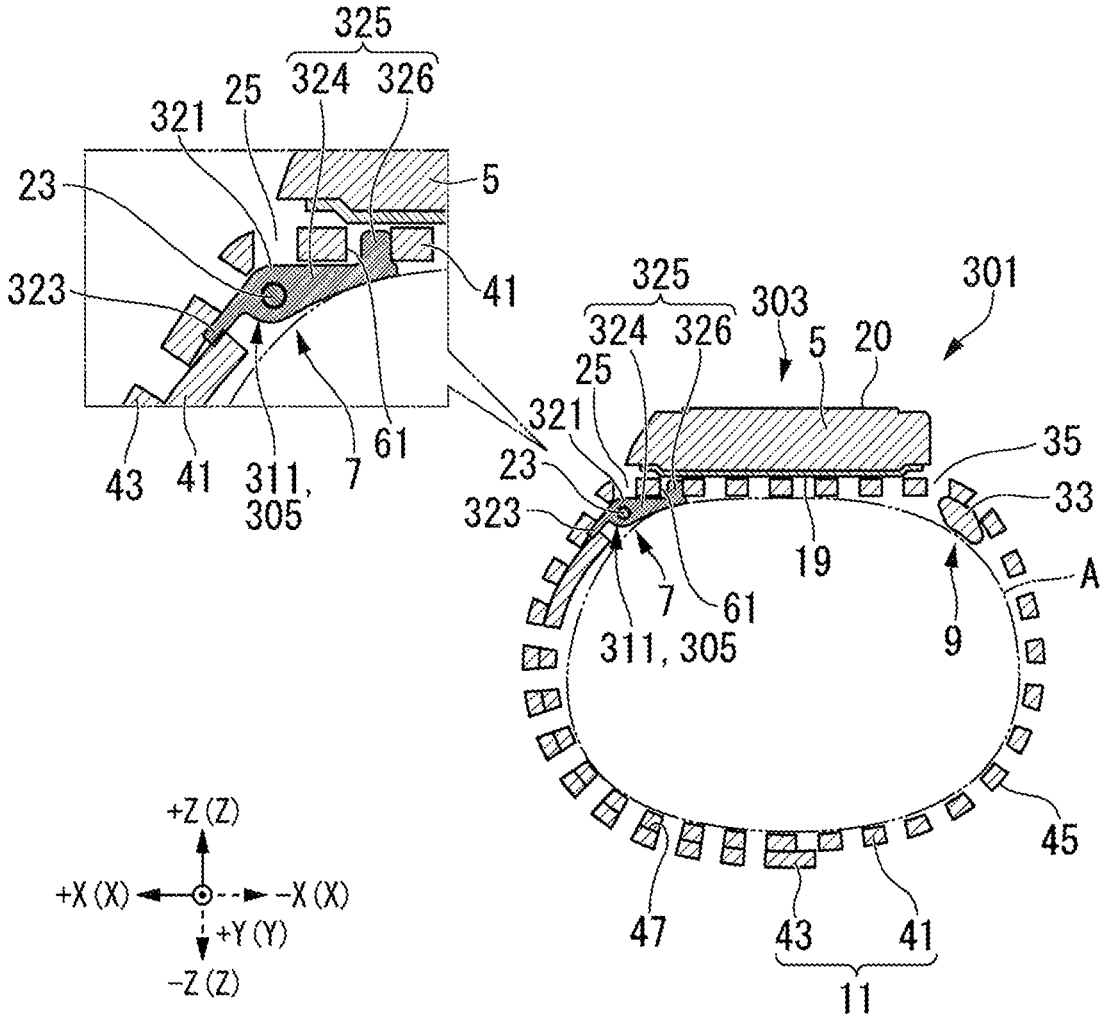
FIG. 13 is a diagram, succeeding to FIG. 12, illustrating the timepiece attachment method.

FIGS. 12 and 13 are diagrams illustrating the timepiece 301 according to the fourth embodiment and the method of attaching the same.

The timepiece 301 is equipped with a timepiece case 303, and a timepiece component (movement). The timepiece case 303 is equipped with the case main body 5, the first bow 7, the second bow 9, the strap 11, and a fixation member 305.

The fixation member 305 is equipped with a lock portion 311. The lock portion 311 is rotatably provided on the first bow 7. The lock portion 311 is equipped with a rotation portion 321, an operation portion 323, and a lock portion main body 325.

The spring bar 23 of the first bow 7 is inserted into an insertion hole, whereby the rotation portion 321 is rotatable around the spring bar 23.

The operation portion 323 is formed, for example, as a flat plate extending from the rotation portion 321. The operation portion 323 is arranged between the main portion 41 and the extension portion 43.

The lock portion main body 325 is equipped, for example, with an arm portion 324 extending from the rotation portion 321, and a lock protrusion 326 provided at the distal end portion of the arm portion 324.

The arm portion 324 extends from the rotation portion 321 in a direction different from that of the operation portion 323. For example, the arm portion 324 substantially extends in a direction opposite to the operation portion 323. The arm portion 324 is arranged on the inner side of the main portion 41.

The lock protrusion 326 protrudes from one surface of the arm portion 324 in a direction crossing the extending direction of the arm portion 324.

In accordance with the rotational position around the spring bar 23, the lock portion 311 can be switched between a non-locking state in which the lock protrusion 326 is not inserted into the lock hole 61 (See FIG. 12) and a locking state in which the lock protrusion 326 is inserted into the lock hole 61 of the main portion 41 for locking (See FIG. 13). In the locking state, of the plurality of lock holes 61 of the main portion 41, the lock protrusion 326 is locked to the lock hole 61 situated in the vicinity of the first passage hole 25. In the locking state, the main portion 41 and the extension portion 43 are regulated in the movement in the length direction.

In this way, the lock portion 311 is locked to the main portion 41, whereby the extension portion 43 is detachably connected to the first bow 7 via the main portion 41 and the lock portion 311.

A method of attaching the timepiece 301 will be described with reference to FIGS. 12 and 13.

[1] Strap 11 Fastening Operation

As shown in FIG. 12, the extension portion 43 is pulled in the state in which the arm A is passed into the main portion 41, and the strap 11 (the main portion 41) is fastened to the arm A.

[2] Strap 11 Fixing Operation

When the extension portion 43 is superimposed on the main portion 41, the operation portion 323 is pushed by the extension portion 43, and the lock portion 311 rotates counterclockwise as seen in FIGS. 12 and 13. Through the rotation of the lock portion 311, of the lock holes 61 of the main portion 41, the lock protrusion 326 of the lock portion main body 325 is locked to the lock hole 61 situated in the vicinity of the first passage hole 25.

Thus, the extension portion 43 is connected to the first bow 7 via the main portion 41 and the lock portion 311. As a result, the strap 11 is fixed, and the timepiece 301 is attached to the arm A.

The effects of the timepiece case 303 will be described.

(1) In the timepiece case 303, the lock portion 311 is locked to the lock hole 61, whereby the extension portion 43 is connected to the first bow 7, so that the strap 11 fixing operation is facilitated. Thus, the timepiece case 303 allows easy attachment.

(2) In the timepiece case 303, the extension portion 43 pushes the operation portion 323, whereby the lock portion 311 rotates, and is locked to the lock hole 61, so that the strap 11 fixing operation is made reliable and easy.

(3) In the timepiece case 303, the lock protrusion 326 of the lock portion 311 is locked to the lock hole 61 of the main portion 41, so that the lock protrusion 326 is hard to see from the outside. Thus, this embodiment is superior in the external view (outward appearance) of the timepiece case.

Apart from this, the timepiece case 303 provides the effects as described in connection with the first embodiment.

Fifth Embodiment

The fifth embodiment of the present invention will be described with reference to FIGS. 14 and 15. The components that are the same as those of the above-described embodiments are indicated by the same reference numerals, and a description thereof will be left out.

Figure 14:
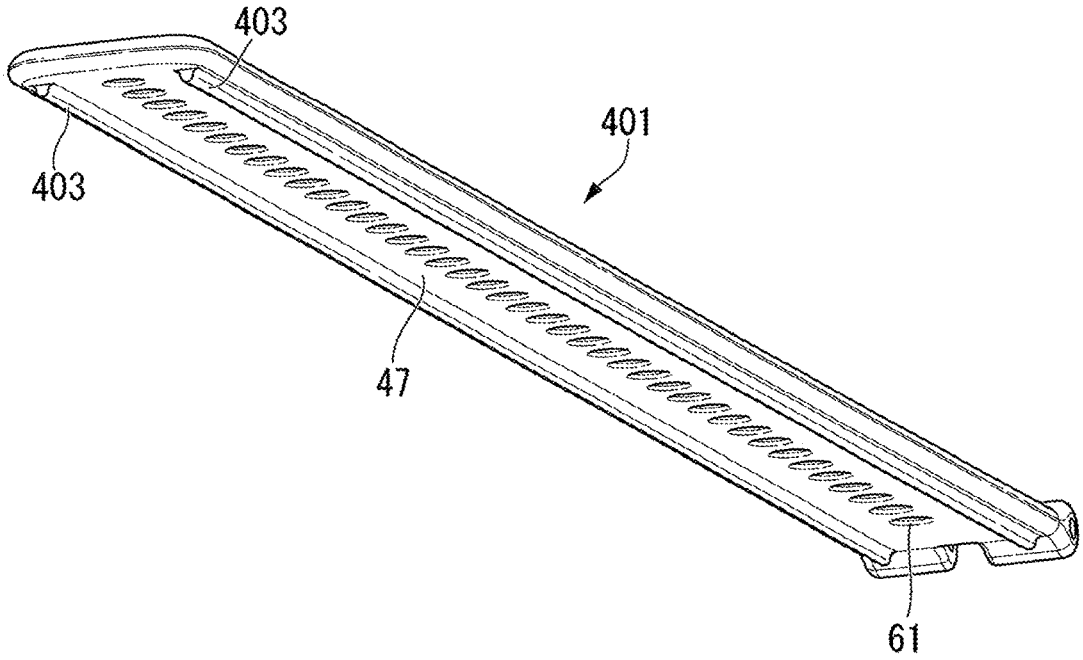
FIG. 14 is a perspective view, as seen from the back side, of a timepiece strap according to a fifth embodiment of the present invention.

FIG. 14 is a perspective view, as seen from the back side, of a strap 401 of a timepiece case according to the fifth embodiment. As shown in FIG. 14, on the back surface 47 of the strap 401, there are provided a pair of protrusions 403 (slip portions). The pair of protrusions 403 are provided so as to be elongated in the length direction of the strap 401. The pair of protrusions 403 are provided at an interval in the width direction of the strap 401.

Figure 15:
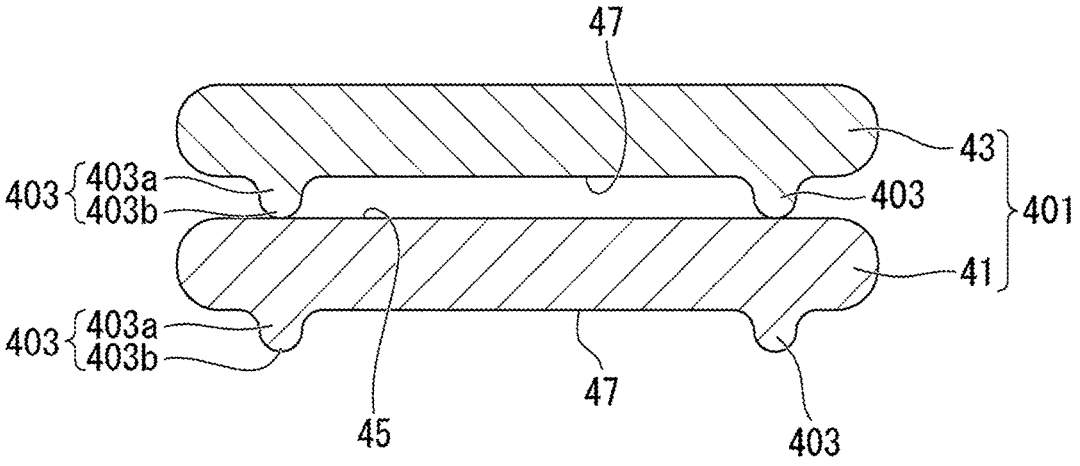
FIG. 15 is a sectional view illustrating how strap portions are superimposed one upon the other at the time of fastening of the strap of the above diagram.

FIG. 15 is a sectional view illustrating how the main portion 41 and the extension portion 43 are superimposed one upon the other when the strap 401 is fastened. FIG. 15 is a sectional view taken along a direction orthogonal to the direction in which the protrusions 403 extend.

As shown in FIG. 15, the protrusion 403 is formed so as to protrude from the back surface 47 of the strap 401. The protruding direction of the protrusion 403 is, for example, a direction perpendicular to the back surface 47 (downwards as seen in FIG. 15).

The protrusion 403 has a proximal portion 403*a* gradually reduced in width toward the distal end, and a distal end portion 403*b* provided at the distal end side of the proximal portion 403*a* and of a curved convex configuration. The distal end portion 403*b* is, for example, of a semi-circular sectional configuration. The protrusion 403 can be formed integrally with the strap 401.

When fastening the strap 401, the extension portion 43 is superimposed on the front surface 45 (contact portion) of the main portion 41. The distal end portions 403*b* of the protrusions 403 provided on the back surface 47 of the extension portion 43 come into contact with the front surface 45 of the main portion 41. Thus, the contact area of the extension portion 43 with respect to the main portion 41 is reduced. As a result, the protrusions 403 can reduce the friction between themselves and the front surface 45 of the main portion 41.

In addition to the front surface 45 of the main portion 41 shown in FIG. 15, examples of the contact portion coming into contact with the extension portion 43 include the spring bar 23 of the first bow 7 (See FIG. 4) and the connection portion 33 of the second bow 9 (See FIG. 4).

The effects of the timepiece case according to the fifth embodiment will be described.

(1) In the timepiece case of the fifth embodiment, the protrusions 403 (slip portions) are formed on the strap 401. As a result, the timepiece case reduces the friction of the strap 401 at the time of the fastening of the strap 401 and moves the strap 401 smoothly, so that the operation of fastening the strap 401 can be conducted easily.

(2) The protrusions 403 can be formed integrally with the strap 401, so that it is possible to suppress the production cost of the timepiece case.

(3) The distal end portions 403*b* of the protrusions 403 are formed in a curved convex configuration, so that the friction at the time of the fastening of the strap 401 is further reduced, facilitating the operation of fastening the strap 401.

While in the timepiece case of the fifth embodiment the protrusions 403 are provided so as to extend in the length direction of the strap 401, the construction of the slip portions is not restricted to the example shown in the drawings. For example, the slip portions may adopt a construction in which a plurality of protrusions are intermittently provided in the length direction of the strap 401.

While in the timepiece case of the fifth embodiment the protrusions 403 are provided solely on the back surface 47, the protrusions 403 may be provided solely on the front surface 45 of the strap 401, or they may be provided on both the front surface 45 and the back surface 47.

Further, the protrusions may be provided on the contact portion with which the strap 401 comes into contact in the case main body 5. More specifically, the protrusions may be provided on the lower surface 19 of the case main body 5

(See FIG. 2), on the spring bar 23 of the first bow 7 (See FIG. 4), and on the connection portion 33 of the second bow 9 (See FIG. 4).

Sixth Embodiment

A timepiece 501 according to the sixth embodiment of the present invention will be described with reference to FIG. 16. The components that are the same as those of the above-described embodiments are indicated by the same reference numerals, and a description thereof will be left out.

Figure 16:
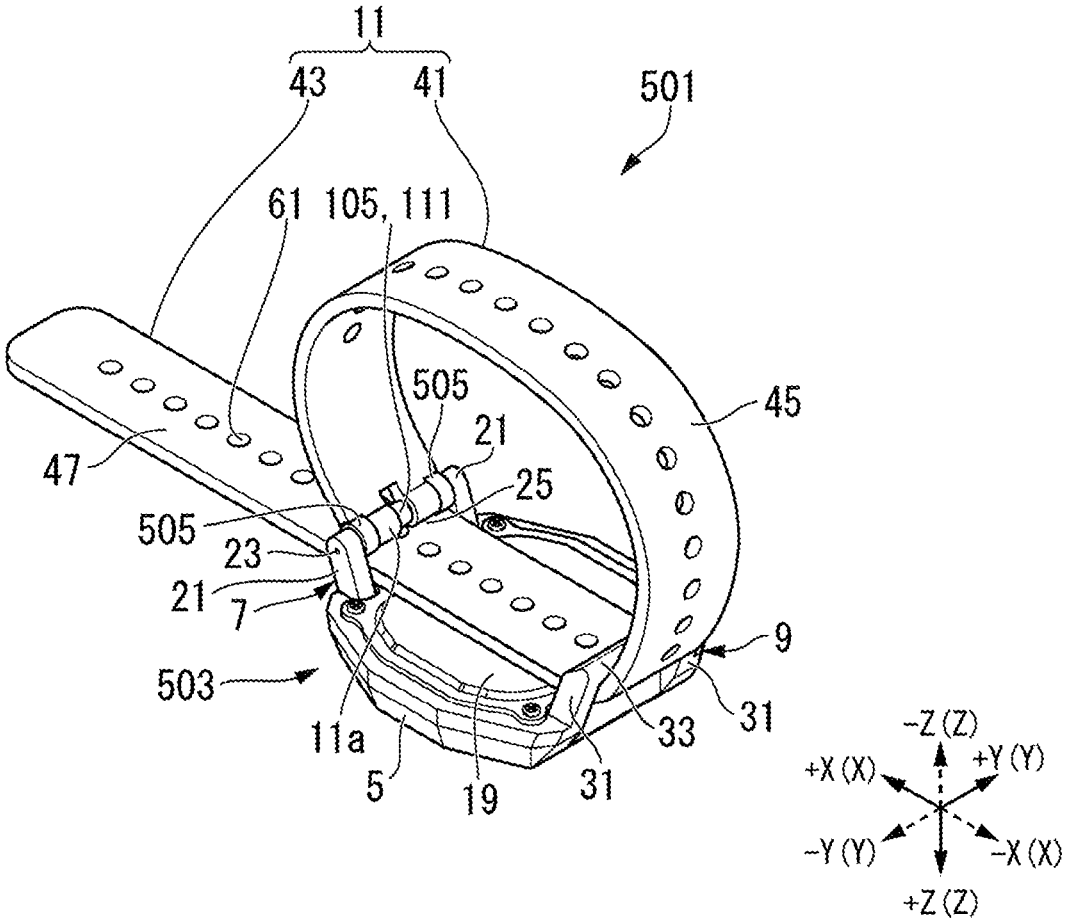
FIG. 16 is a perspective view, as seen from the back side, of a timepiece according to a sixth embodiment of the present invention.

FIG. 16 is a perspective view, as seen from the back side, of the timepiece 501 of the sixth embodiment. The timepiece 501 is equipped with a timepiece case 503, and a timepiece component (movement). The timepiece case 503 is equipped with the case main body 5, the first bow 7, the second bow 9, the strap 11, and the fixation member 105.

In the timepiece case 503, a pair of rotation members 505 (slip portions) are provided on the spring bar 23. The rotation members 505 are cylindrical members having, for example, insertion holes. The spring bar 23 is inserted into the insertion holes. The rotation members 505 are respectively arranged at both end portions in the length direction (the Y-direction) of the spring bar 23.

The outer diameter of the rotation members 505 is larger than the outer diameter of the one end portion 11*a* of the strap 11. As described above, the one end portion 11*a* is rotatable around the axis of the spring bar 23, so that the rotation members 505 are relatively rotatable around the axis of the spring bar 23 with respect to the one end portion 11*a*. The rotation members 505 may be rotatable around the axis with respect to the spring bar 23, or may be fixed to the spring bar 23. The sum total of the length (the dimension in the Y-direction) of the rotation members 505 is shorter than the entire width (the dimension in the Y-direction) of the one end portion 11*a* of the strap 11.

When it is inserted into the first passage hole 25 for fastening and moves in the length direction, the strap 11 (the portion including the other end portion 11*b*) abuts the rotation members 505, but it does not easily abut the one end portion 11*a* of the strap 11 of a small outer diameter. Thus, it is possible to suppress the contact area with which the strap 11 comes into contact with the other members. Thus, it is possible to reduce the friction at the time of the fastening of the strap 11.

In the case where the rotation members 505 are rotatable with respect to the spring bar 23, the rotation members 505 also rotate as the strap 11 moves at the time of the fastening of the strap 11. Thus, it is possible to further reduce the friction at the time of the fastening of the strap 11.

The effects of the timepiece case 503 will be described.

(1) The timepiece case 503 is equipped with the rotation members 505, so that it is possible to reduce the friction at the time of the fastening of the strap 11. Thus, it is possible to easily fasten the strap 11. Thus, the timepiece 503 allows easy attachment.

(2) In the timepiece case 503, in the case where the rotation members 505 are rotatable, it is possible to reduce the friction of the strap 11 by utilizing the rotation of the rotation members 505. Thus, the strap 11 can be easily fastened.

While in the timepiece case 503 the rotation members 505 are provided on the spring bar 23 (contact portion), it is only necessary for the construction of the slip portion to be one capable of reducing the friction between the strap 11 and the contact portion, and it is not restricted to the example shown. For example, while in the timepiece case 503 two rotation members 505 are used, there are no particular restrictions regarding the number of rotation members. It may be an arbitrary number of one or more. The rotation members are not restricted to be the cylindrical configuration. They may be of spherical configuration. Further, the slip portions may not be rotatable so long as they are of a structure capable of reducing the friction between themselves and the strap. The rotation members may be mounted to the strap, for example, so as to be rotatable around the spring bar.

While in the timepiece cases of the fifth embodiment and of the sixth embodiment the protrusions 403 and the rotation members 505 are respectively used as the slip portions, both the protrusions 403 and the rotation members 505 may be used. Further, apart from the protrusions and the rotation members, the slip portions may, for example, be a sheet of high slipping property.

The specific construction is not restricted to that of the embodiments described in detail above, and a change in design not departing from the scope of the gist of the present invention is included in the present invention.

Figure 17:
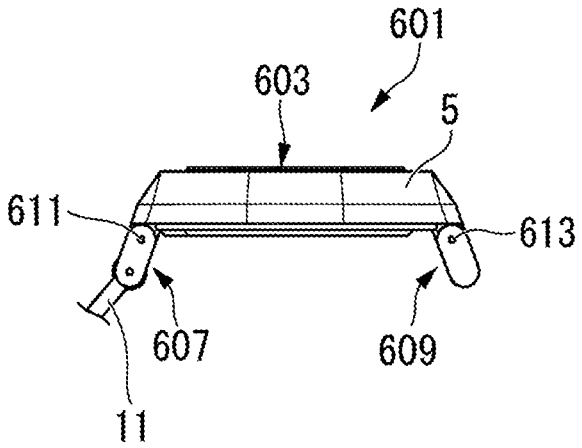
FIG. 17 is a side view of an upper portion of a timepiece according to another embodiment of the present invention.

For example, as in the case of a timepiece case 603 shown in FIG. 17, a first bow 607 and a second bow 609 may be provided on the case main body 5 so as to be rotatable respectively around rotation shafts 611 and 613. Further, one of the first bow 607 and the second bow 609 may be rotatably provided on the case main body 5. In this structure, it is possible to enhance the attachment property of the timepiece case 603. In FIG. 17, numeral 601 indicates a timepiece employing the timepiece case 603.

Regarding the timepiece case (and the timepiece) of the above embodiments, there have been described the case where there is provided a fixation member for fixing the strap 11 to the first bow 7, and the case where there is provided a fixation member for fixing the extension portion 43 of the strap 11 to the main portion 41.

Figure 18:
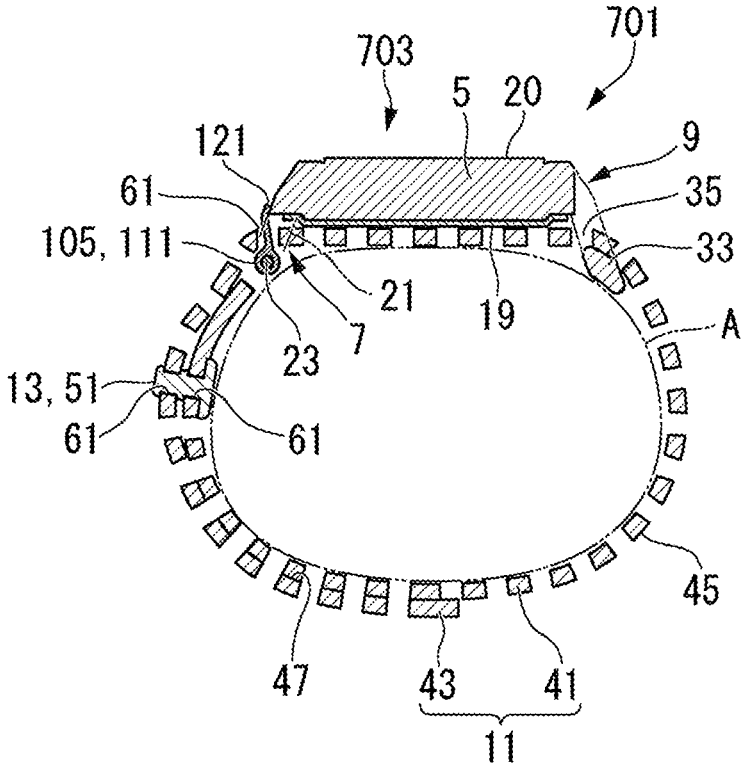
FIG. 18 is a sectional view of a timepiece according to another embodiment of the present invention.

The timepiece case (and the timepiece) are not restricted to these. As in the case of a timepiece case 703 (and a timepiece 701) shown in FIG. 18, both the fixation member 105 for fixing the extension portion 43 to the first bow 7 and the fixation member 13 for fixing the extension portion 43 to the main portion 41 may be provided.

In the timepiece case 703, the strap 11 is fixed in a stable manner by two fixation members 13 and 105, so that it is possible to enhance the attachment comfort.

The fixation member for fixing the extension portion to the main portion may be at least one of a free ring and a magnet. The magnet is a permanent magnet or the like, and fixes the extension portion to the main portion by a magnetic force. For example, it is possible to show a construction in which a magnet is provided on one of the extension portion and the main portion and in which at least a part of the other consists of a magnetic metal. Further, it is possible to use a plurality of fixation members.

Figure 19:
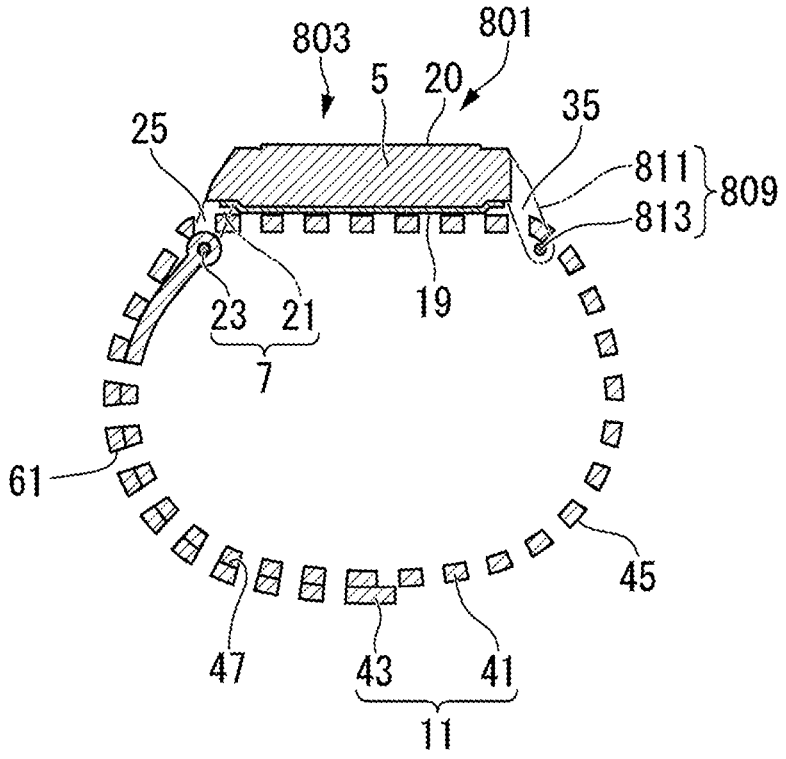
FIG. 19 is a sectional view of a timepiece according to another embodiment of the present invention.

While in the timepiece case 3 (and the timepiece 1) of the embodiment shown in FIGS. 1 and 2, the second bow 9 is composed of the second bow legs 31 and the connection portion 33, the timepiece case (and the timepiece) of the embodiment may adopt the construction as shown in FIG. 19. In a timepiece case 803 (and a timepiece 801) shown in FIG. 19, a second bow 809 is composed of second bow legs 811 and a spring bar 813. In the timepiece case 803, it is possible to obtain a fixation structure of high strength independently of the material of the case main body 5. In FIG. 19, the fixation member is omitted.

Figure 20:
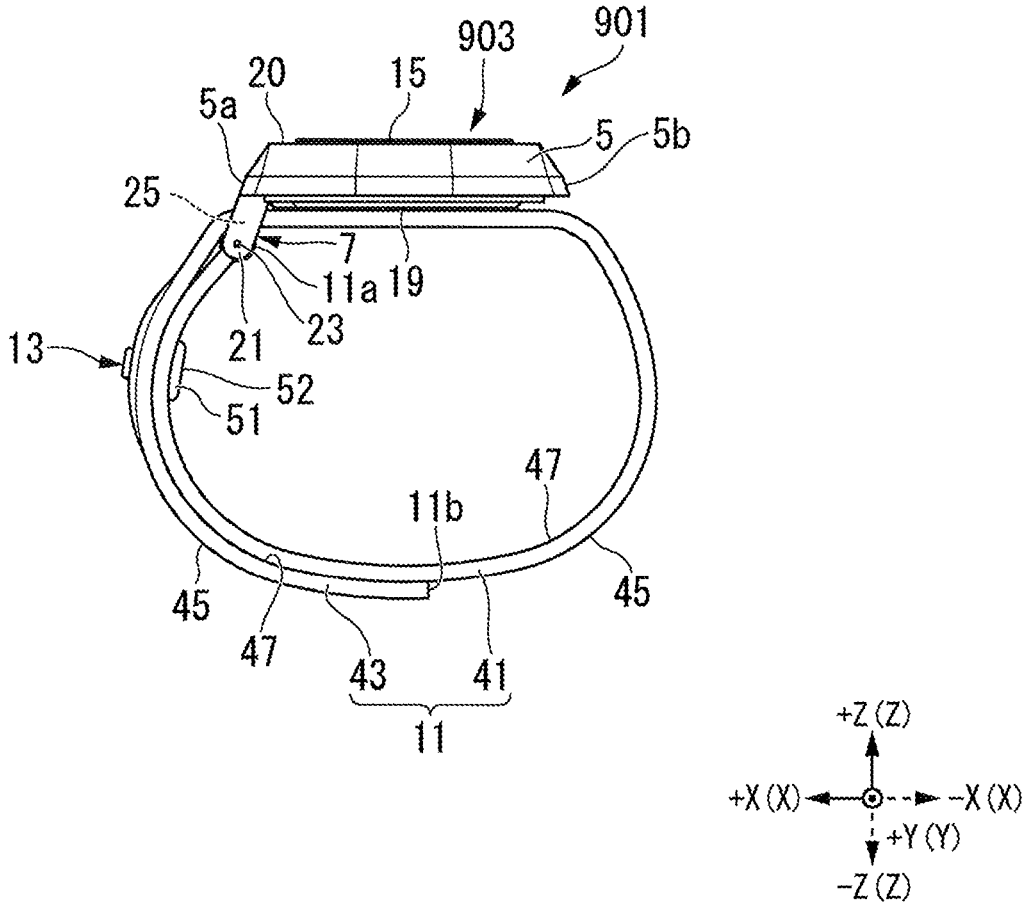
FIG. 20 is a side view of a timepiece according to another embodiment of the present invention.

While the timepiece case 3 (and the timepiece 1) of the embodiment shown in FIGS. 1 and 2 is equipped with the first bow 7 and the second bow 9, the timepiece case (and the timepiece) of the embodiment may adopt the construction as shown in FIG. 20. A timepiece case 903 (and a timepiece 901) as shown in FIG. 20 differs from the timepiece case 3 (and the timepiece 1) shown in FIGS. 1 and 2 in that it is equipped with no second bow.

While in the above-described embodiments the present invention is applied to a timepiece case, the present invention is applicable to any other portable apparatus case equipped with a strap. While in the above-described embodiments the present invention is applied to a portable apparatus case attached to the arm, the object of attachment is not restricted to the arm. For example, the present invention may be applied to a portable apparatus case attached to a body portion other than the arm.

The portable apparatus component is not restricted to a timepiece movement. For example, it may be a component of an apparatus such as an activity tracker, a heart rate meter, a pedometer, an altimeter, or a barometer.

What is claimed is:

1. A portable apparatus case comprising:

a case main body having an upper surface and a lower surface;

first and second strap mounting portions each having a passage hole and provided at opposite sides of the case main body;

a strap being wound around an arm of a user to make a loop such that the strap overlaps itself for a length of an overlapping section of the strap, wherein the strap has first and second opposite ends, the first end being mounted to the first strap mounting portion, and the strap passes only once through each of the passage holes, and wherein the strap is formed with a line of lock holes along the length of the strap; and a fixation member provided on the first strap mounting portion for rotation around the first strap mounting portion, the fixation member comprising a rotation portion rotatable around the first strap mounting portion and an operation portion and a lock portion extending from the rotation portion on opposite sides of the rotation portion, wherein the operation portion is configured to be operated to rotate around the first strap mounting portion to rotate the lock portion, and the lock portion is configured to engage one of the lock holes when rotated around the first strap mounting portion.

2. The portable apparatus case according to claim 1, wherein the lock portion of the fixation member comprises a lock end provided at a distal end of the lock portion, and the lock end is detachably inserted in said one of the lock holes.

3. The portable apparatus case according to claim 1, wherein the strap comprises a series of projections each having a top being in contact with the strap over at least a part of the length of the overlapping section to reduce friction between the overlapping straps over the length of the overlapping section.

4. The portable apparatus case according to claim 3, wherein the the tops of the series of projections are each formed in a curved convex configuration.

5. The portable apparatus case according to claim 3, wherein at least one of the first or second strap mounting portion comprises a cylinder rotatable around an axis crossing a length direction of the strap to make passing of the strap through the passage hole less frictional.

6. A portable apparatus comprising the portable apparatus case as claimed in claim 1, and a portable apparatus component accommodated in the portable apparatus case.

7. A timepiece comprising the portable apparatus case as claimed in claim 1, and a movement accommodated in the portable apparatus case.

* * * * *